United States Patent [19]

Pace et al.

[11] 4,215,748

[45] Aug. 5, 1980

[54] LOCKOUT FOR A WELL INJECTION VALVE

[75] Inventors: Clare A. Pace, Anchorage, Ak.; Ronald E. Pringle, Houston, Tex.

[73] Assignee: Camco, Incorporated, Houston, Tex.

[21] Appl. No.: 2,650

[22] Filed: Jan. 11, 1979

[51] Int. Cl.[2] ..... E21B 43/12

[52] U.S. Cl. ..... 166/322; 166/323; 251/94

[58] Field of Search ..... 166/323, 322, 321; 251/89, 79, 80, 94

[56] References Cited

U.S. PATENT DOCUMENTS

| | | | |
|---|---|---|---|
| 3,786,866 | 1/1974 | Tausch et al. | 166/322 |
| 3,865,141 | 2/1975 | Young | 251/80 |
| 3,981,358 | 9/1976 | Watkins | 166/323 |
| 4,077,473 | 3/1978 | Watkins | 251/79 |

*Primary Examiner*—William F. Pate, III
*Attorney, Agent, or Firm*—Fulbright & Jaworski

[57] ABSTRACT

A lockout for use with a fluid injection valve which injects fluids in a tubing string of a well. The lockout, when actuated, holds the injection valve open for allowing passage of well tools therethrough; but when deactuated, allows the injection valve to operate normally. In combination with a spring-loaded, normally closed injection valve, which is opened by pressure actuating a flow tube in response to injection flow, of a lockout having a second flow tube coaxially aligned with the first flow tube for engagement therewith, piston means connected to the second flow tube and adapted to be actuated by fluid pressure from the well surface for moving the second flow tube against the first flow tube for holding the injection valve open, and a biasing spring acting against the second flow tube for moving the second flow tube away from the first flow tube whereby the injection valve may operate normally and independently of the lockout.

2 Claims, 6 Drawing Figures

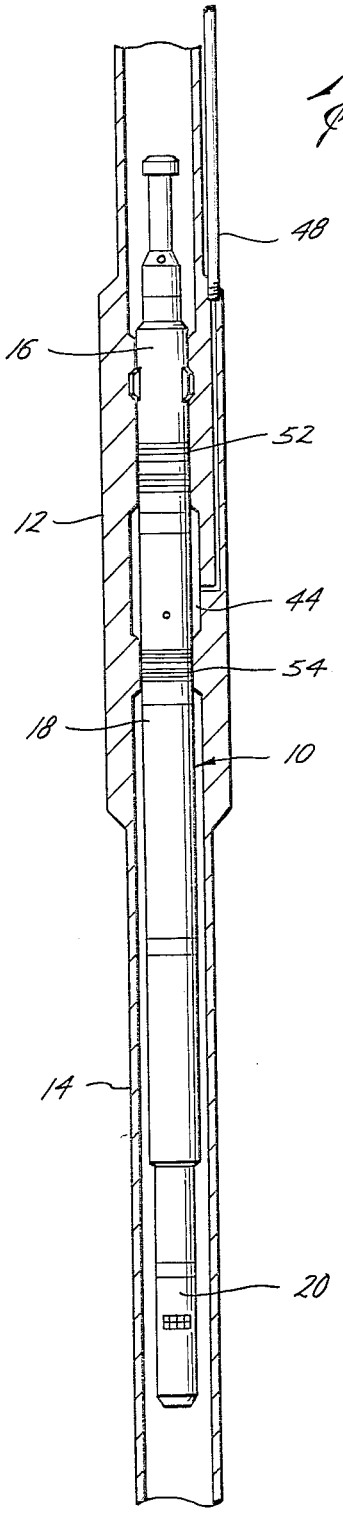
Fig. 1
Fig. 3
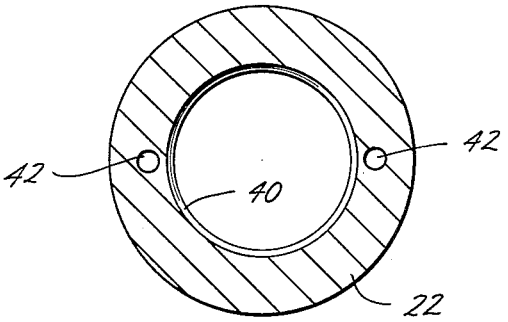

LOCKOUT FOR A WELL INJECTION VALVE

BACKGROUND OF THE INVENTION

It is conventional to utilize a fluid injection valve, such as a Camco Series A valve, in wells in which fluids are injected for various purposes such as secondary recovery and disposal or fluid storage. Such a valve may be a spring-loaded, normally closed, flow check valve which is opened by a pressure differential generated by the injected fluid passing through the valve. However, it may be desirable to perform work in the well below the injection valve and in such event the valve must be locked out or held in the open position for allowing the passage of well tools, such as conventional wireline well tools.

The present invention is directed to a lockout in combination with a well injection valve in which the lockout can be controlled from the well surface and temporarily hold the injection valve in the open position when desired, but otherwise does not interfere with the normal operation of the injection valve.

SUMMARY

The present invention is directed to a lockout for use with a fluid injection valve, which injects fluids into the tubing string of a well, for holding the injection valve in the open position, when desired, but allowing the injection valve to operate normally when the lockout is deactuated.

A further object of the present invention is the provision of the combination of a lockout with a spring-loaded, normally closed, injection valve which is open by pressure actuating a flow tube in response to injection flow. The lockout includes a second flow tube coaxially aligned with the first flow tube for engagement therewith, piston means connected to the second flow tube and adapted to be actuated by fluid pressure from the well surface for moving the second flow tube against the first flow tube for holding the injection valve open, and biasing means acting against the second flow tube for moving the second flow tube away from the first flow tube when the fluid pressure is relieved whereby the injection valve may operate normally.

Yet a still further object of the present invention is the combination of a temporary lockout and an injection valve for use in the tubing string of a well which includes a housing, a valve element in the housing, a first tube longitudinally movable in the housing for controlling the actuation of the valve element. The first tube includes a pressure differential means responsive to injection flow in the housing for moving the tube in a direction for moving the valve element to the open position, and a first biasing means connected to the first tube for moving the tube in a direction allowing the valve element to move to the closed position. The hydraulic lockout includes a second tube movable in the housing and coaxially aligned with and positioned above the first tube for engagement therewith, piston means in the housing engaging the second tube and adapted to be actuated by hydraulic pressure from the well surface for moving the second tube against the first tube for moving and holding the valve element in the open position, and biasing means acting against the second tube for moving the second tube away from the first tube whereby the valve may operate independently of the lockout.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 1 is an elevational view, partly in cross section, of the present invention in use in a well tubing, FIG. 3 is a cross-sectional view taken along the line 3—3 of FIG. 2B.

DESCRIPTION OF THE PREFERRED EMBODIMENT

Figure 2A:
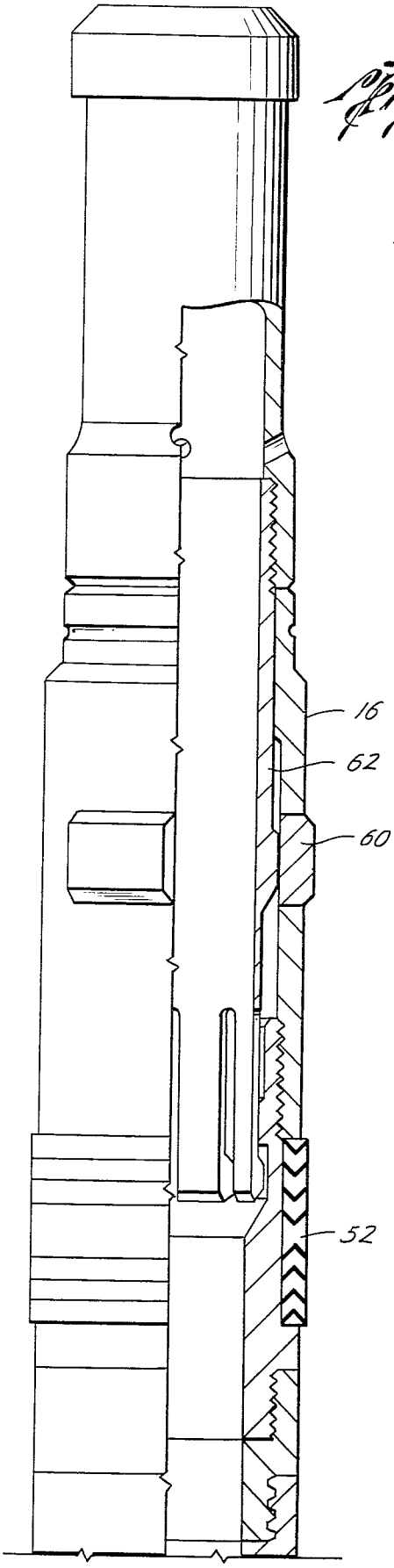
FIGS. 2A, 2B, 2C and 2D are continuations of each other and are enlarged, elevational views, partly in cross section of the present invention shown in the locked out position.

Referring now to the drawings and particularly to FIG. 1, the reference numeral 10 generally indicates the combination of an injection valve and lockout for installation in a landing nipple 12 in the tubing string 14 of a well. The apparatus 10 generally includes a locking section 16 for supporting the apparatus 10 in the landing nipple 12, a hydraulically actuated lockout assembly 18, and an injector valve 20.

Figure 2B:
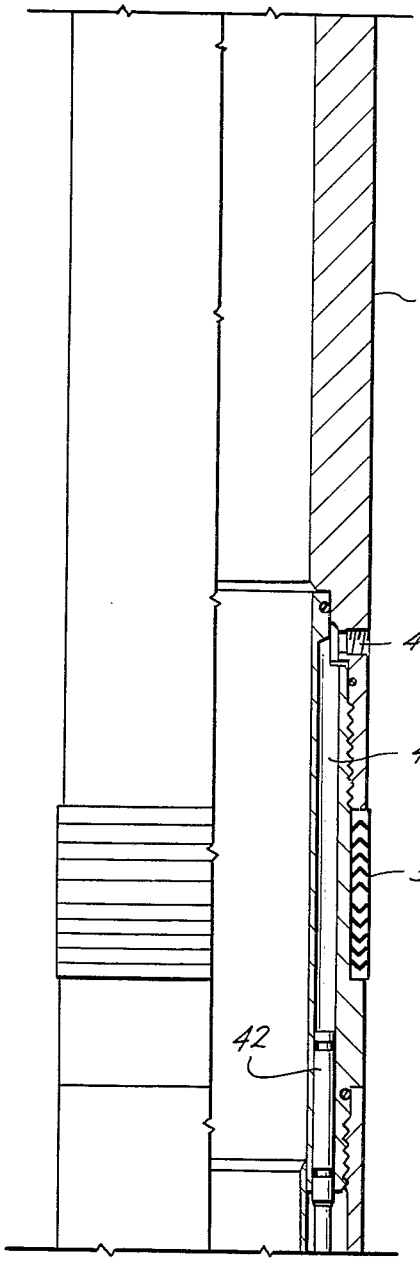
Figure 2C:
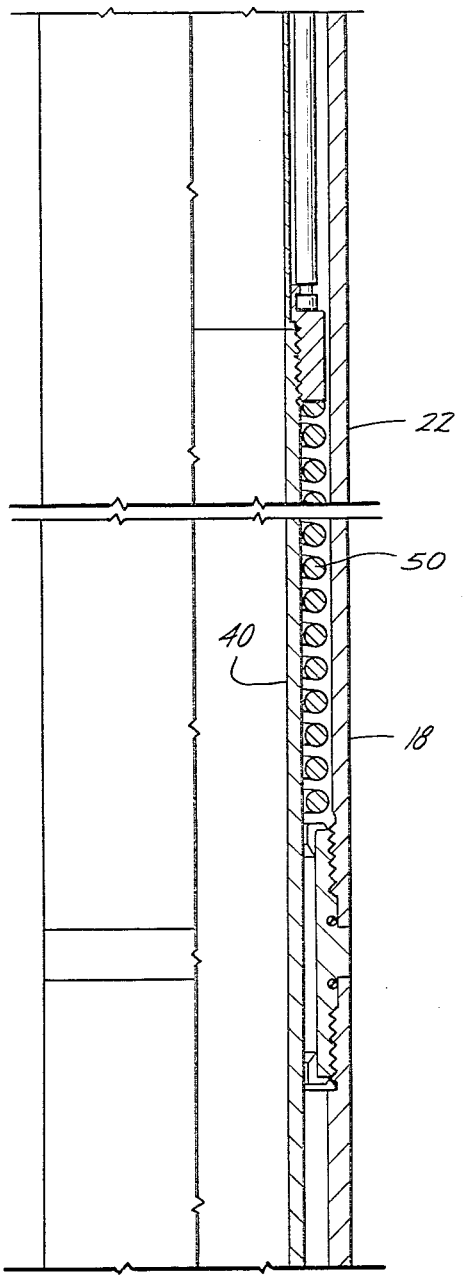
Figure 2D:
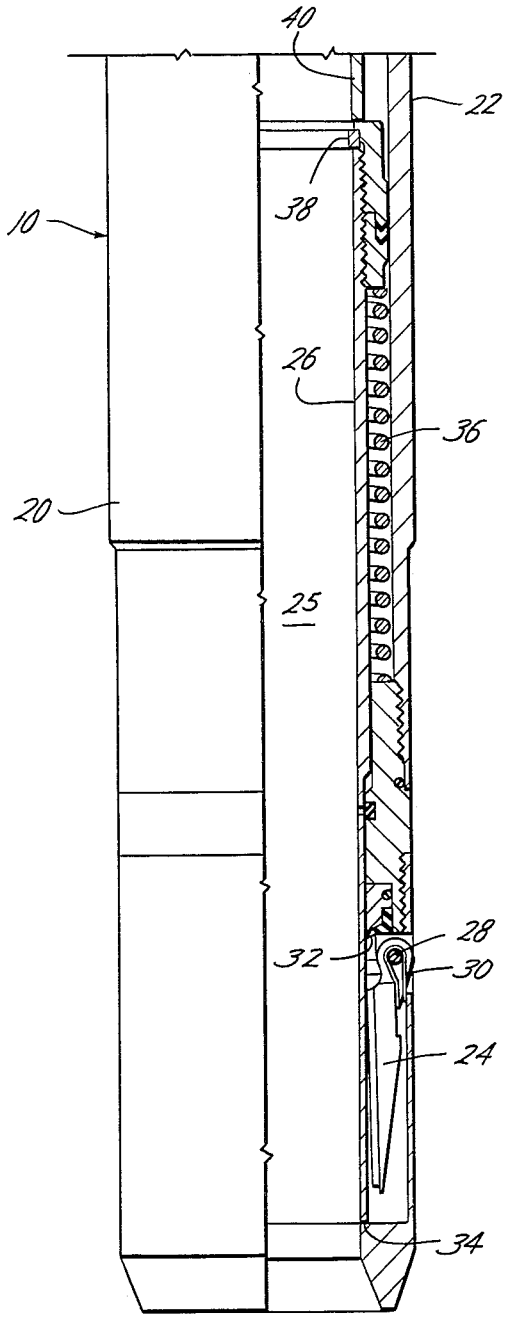

Referring first to FIG. 2D, the injector valve assembly 20 is best seen. The apparatus 10 includes a housing 22 in which is positioned a valve closure element, such as flapper valve 24, a longitudinally movable actuating member or flow tube 26 for controlling the movement of the flapper valve 24. The flapper valve 24 is carried about a pivot 28 and may include a spring 30 for yieldably urging the flapper valve 24 about the pivot 28 and onto an annular valve seat 32 for closing the valve assembly 20 and blocking upward flow of fluid through the bore 25 of the apparatus 10 and tubing 14. The tube 26 is longitudinally movable in the housing 22 and when the lower end 34 of the tube 26 is moved downwardly and contacts the flapper 24, the flapper 24 is moved off of the valve seat 32 and into a downward and open position as shown thereby permitting fluid flow through the bore 25. However, when the flow tube 26 is moved upwardly, its lower end is moved above the valve seat 32, and the spring 30 and/or fluid flow upwardly closes the flapper 24. The flow tube 26 is biased upwardly by spring 36 whereby the injection valve assembly 20 forms a spring-loaded, normally closed, check valve. The flow tube 26 is normally moved downwardly by forces generated by a flowing injection stream moving downwardly through the bore 25 to keep the flow tube 26 downwardly and the flapper valve 24 open. That is, the flow tube 26 includes a suitably sized choke 38 whereby a pressure differential is generated by the downwardly flowing injection stream as it flows through the choke 38 to generate a force to move the tube 26 downwardly and hold the flapper 24 in the open position.

The above described injection valve 20 is generally the same structure and operation as the Camco A-1 injection valve and can be used in wells into which fluids are injected for the purpose of secondary recovery, disposal or fluid storage as well as other uses.

However, it is desirable that the valve 24 be held in the open position or locked out in order that well tools, such as various conventional wireline tools may pass through the valve to perform desired operations therebelow. The present invention is directed to the provision of a hydraulic lockout assembly 18 in combination with the injection valve 20 which is controlled from the well surface and which will hold the valve 24 in the open position as shown, but which operates independently of the injection valve assembly 20 so as not to interfere with the normal operation of the injection valve 20. Referring now to FIGS. 2C and 2D, a second longitudinally movable flow valve 40 is positioned in the housing 22 and is coaxially aligned with the first flow tube 26 for engagement therewith. Suitable pistons, such as pistons 42 (FIGS. 2B and 3) engage the flow tube 40 and are adapted to be actuated by hydraulic pressure in the chamber 44 which is supplied through a port 46 from the landing nipple 12 (FIG. 1) and a fluid passageway 48 extending to the well surface. When fluid pressure is exerted through the passageway 48 to the pistons 42, the second flow tube 40 is moved downwardly into engagement with the first flow tube 26 and moves the first flow tube 26 downwardly to open the valve 24 and hold the valve 24 in the open position so long as the fluid in line 48 remains pressurized as seen in FIG. 2D.

Biasing means such as spring 50 (FIG. 2C) acts against the second flow tube 40 for moving the second flow tube away from the first flow tube 26 when pressure in the fluid passageway 48 is relieved thereby allowing the injection valve assembly 20 to operate independently and in its normal manner when the hydraulic lockout 18 is deactuated.

Referring now to FIGS. 1, 2A and 2B, seals 52 and 54 are provided on opposite sides of the port 46 for sealing in the landing nipple 12 for placing the port 46 in communication with the fluid passageway 48.

Referring to FIG. 2A, any suitable locking assembly 16 may be utilized for supporting the apparatus 10 in the landing nipple 12 or otherwise in the tubing string 14. The locking assembly 16, as shown, is a conventional Camco lock in which the locking dogs 60 have been moved outwardly into a locked position by sleeve 62 for engaging the landing nipple 12 for supporting the apparatus 10 therein against either upward or downward movement.

In operation, the apparatus 10 is conventionally installed in a well string 14 in a well such as in a landing nipple 12 by actuation of a well lock assembly 16. The injection valve assembly 20 may be normally operated to inject well fluids downwardly through the well tubing 14 as desired and the injection fluid acts on the choke 38 to hold the valve 24 in the open position while fluid injection continues. As soon as fluid injection ceases, the spring 36 will bias the flow tube 26 upwardly and the flapper 24 will swing to the closed position. However, in the event that it is desired to move well tools through the injection valve 20, fluid pressure is applied to the fluid passageway 48 to act on the pistons 42 which in turn move the second flow tube 40 downwardly against the first flow tube 26 and cause the first flow tube 26 to move downwardly opening the valve 24. When it is desired to reclose the flapper valve 24, pressure is discontinued in the fluid passageway 48 and spring 50 will bias the flow tube 40 away from the flow tube 26 thereby allowing the injection valve assembly 20 to again close. So long as the fluid pressure in the passageway 48 is relieved, the injection valve assembly 20 will operate in its normal manner.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, may be made without departing from the spirit and scope of the invention as hereinafter claimed.

What is claimed is:

1. In combination with an injection valve for injecting fluids in the tubing string of a well and which is opened by pressure actuating a flow tube in response to injection flow in which the flow tube is spring biased towards the closed position, of a valve lockout comprising, a second flow tube coaxially aligned with the first flow tube for engagement therebut but unconnected thereto, piston means connected to the second flow tube and adapted to be actuated by fluid pressure from the well surface for moving the second flow tube against the first flow tube for holding the injection valve open, and biasing means acting against the second flow tube for moving the second flow tube away from the first flow tube whereby the injection valve may operate normally.

2. The combination of a temporary lockout with an injection valve for use in the tubing string of a well comprising, a housing, a valve element in the housing, a first tube longitudinally movable in the housing for controlling the actuation of the valve element, pressure differential means connected to the first tube and responsive to injection flow in the housing for moving the tube in a direction for moving the valve element to the open position, first biasing means connected to the first tube for moving the tube in a direction for allowing the valve element to move to the closed position, a second tube movable in the housing and coaxially aligned with and positioned above the first tube for engagement therewith, piston means in the housing engaging the second tube and adapted to be actuated by hydraulic pressure from the well surface for moving the second tube against the first tube for holding the valve element in the open position, and biasing means acting against the second flow tube for moving the second tube away from the first tube whereby the valve may operate normally.

* * * * *

Dedication 4,215,748.—*Clare A. Pace,* Anchorage, Ak. and *Ronald E. Pringle,* Houston, Tex. LOCKOUT FOR A WELL INJECTION VALVE. Patent dated Aug. 5, 1980. Dedication filed Oct. 1, 1981, by the assignee, *Camco, Inc.*

Hereby dedicates to the Public the entire term of said patent.

[*Official Gazette May 4, 1982.*]